US008042515B2

(12) United States Patent
Kato

(10) Patent No.: US 8,042,515 B2
(45) Date of Patent: Oct. 25, 2011

(54) THROTTLE DEVICE

(75) Inventor: Takahiro Kato, Odawara (JP)

(73) Assignee: Mikuni Corporation, Tokyo (JP)

( * ) Notice: Subject to any disclaimer, the term of this patent is extended or adjusted under 35 U.S.C. 154(b) by 256 days.

(21) Appl. No.: 12/461,822

(22) Filed: Aug. 25, 2009

(65) Prior Publication Data

US 2010/0050984 A1 Mar. 4, 2010

(30) Foreign Application Priority Data

Aug. 26, 2008 (JP) ..... 2008-216870

(51) Int. Cl.
*F02D 9/10* (2006.01)

(52) U.S. Cl. ..... 123/337; 123/399; 251/305

(58) Field of Classification Search ..... 123/337, 123/399; 251/304, 305, 308
See application file for complete search history.

(56) References Cited

U.S. PATENT DOCUMENTS

| | | | | |
|---|---|---|---|---|
| 6,923,157 | B2 * | 8/2005 | Torii et al. | 123/337 |
| 7,493,888 | B2 * | 2/2009 | Ikegawa | 123/336 |
| 2001/0037794 | A1 * | 11/2001 | Wayama et al. | 123/399 |
| 2004/0187844 | A1 * | 9/2004 | Torii et al. | 123/337 |

FOREIGN PATENT DOCUMENTS

JP 2007-023859 2/2007

* cited by examiner

*Primary Examiner* — Erick Solis

(57) ABSTRACT

A compact throttle device with a short air intake pipe length. A throttle device includes: throttle bodies that define air intake paths; throttle valves that are disposed in the air intake paths and adjust the air flow rate in the air intake paths; a throttle shaft that rotatably supports the throttle valves; a motor that rotates the throttle shaft; and a gear that connects the throttle shaft to the motor. A pin is provided as a protrusion on the peripheral surface of the throttle shaft. The gear externally fitted and fixed to the throttle shaft has, on a fixing ring that is externally fitted to the throttle shaft, a housing groove for housing the pin, the housing groove being impelled against the pin by a spring.

4 Claims, 7 Drawing Sheets

Fig. 7A – Prior Art
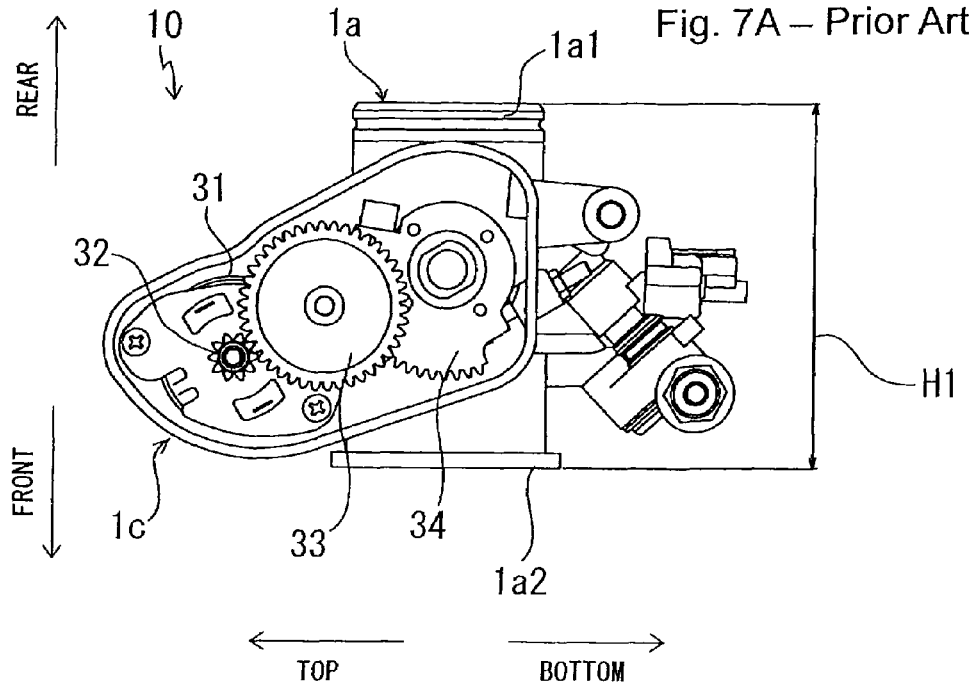
Fig. 7B
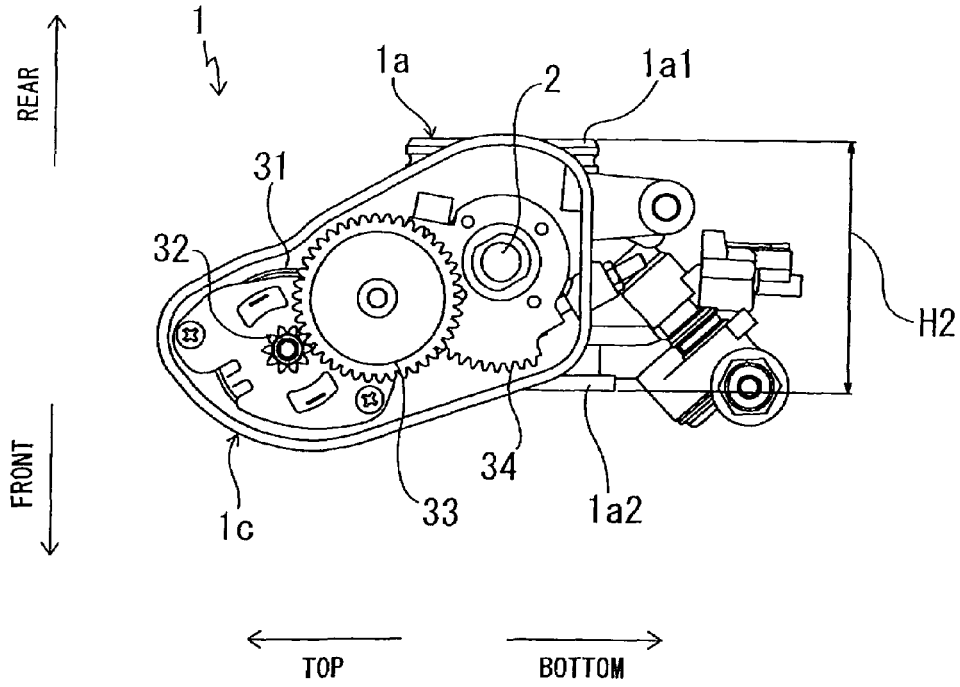

THROTTLE DEVICE

CROSS-REFERENCE TO RELATED APPLICATIONS

This application claims the benefit of Japanese Application No. 2008-216870, filed Aug. 26, 2008, in the Japanese Intellectual Property Office, the disclosure of which is incorporated herein by reference.

BACKGROUND OF THE INVENTION

1. Field of the Invention

The present invention relates to a throttle device having a gear that connects a throttle shaft and a motor.

2. Description of the Related Art

In a conventional throttle device, as disclosed in Japanese Patent Application Laid-open No. 2007-23859, each of the throttle shafts provided in the two throttle bodies are fitted from the outside to a gear provided in a gear case disposed between the two throttle bodies.

The throttle device disclosed in the above Japanese Patent Application Laid-open No. 2007-23859 has problems including that the two throttle shafts are connected to a gear, but the structure of the connection of the two shafts to the gear is complex, and the rotational responsiveness of the throttle valves is poor due to the increase in weight. Also, to ensure the connection stiffness between the two throttle shafts and the gear, the external fitting portion of the gear to which the throttle shaft is fitted is made large, and as a result the size of the gear case must be made larger. When the space between the throttle bodies is reduced by making the gear case larger, it is necessary to provide the fitting portions for fitting the mating components in the throttle bodies in a location that projects from the gear case, so the overall length of the air intake pipes is lengthened. Therefore the capacity of the air intake pipe on the downstream side of the throttle valve from the throttle valve to the cylinder head becomes larger, and this has the problem that the engine responsiveness becomes poorer.

SUMMARY OF THE INVENTION

With the foregoing in view, it is an aspect of the present invention to provide a compact throttle device that can improve the engine responsiveness and shorten the air intake pipe, without worsening the responsiveness of the fitted throttle valve.

Additional aspects and/or advantages will be set forth in part in the description which follows and, in part, will be apparent from the description, or may be learned by practice of the invention.

The foregoing and/or other aspects of the present invention are achieved by providing a throttle device including a throttle body that defines an air intake path; a throttle valve that is disposed in the air intake path and adjusts an air flow rate in the air intake path; a throttle shaft that rotatably supports the throttle valve; a motor that rotates the throttle shaft; and a gear that connects the throttle shaft to the motor, wherein a protrusion is provided on a peripheral surface of the throttle shaft, and the gear externally fitted and fixed to the throttle shaft has, on an external fitting portion that is externally fitted to the throttle shaft, a housing groove to house the protrusion, the housing groove being impelled against the protrusion by impelling means.

The gear may be provided within a gear case, the gear case may be constituted from an assembly of a pair of lid members, at least one of the lid members may be formed integrally with the throttle body, and the throttle body and the lid member may be partitioned by a depression portion.

The housing groove may be formed in a shape tapering from an entrance to the groove to a bottom thereof.

In the throttle body, by pressing the housing groove provided in the external fitting portion of the gear against the protrusion on the throttle shaft, it is possible to securely fix the gear to the throttle shaft, so by reducing the size of the gear case and providing depression space between the throttle bodies, it is possible to provide a compact throttle device with short air intake pipe length without adversely affecting the rotational responsiveness of the throttle valves in a multiple throttle device having a plurality of throttle valves. In this way it is possible to improve the engine responsiveness.

BRIEF DESCRIPTION OF THE DRAWINGS

These and/or other aspects and advantages will become apparent and more readily appreciated from the following description of the embodiments, taken in conjunction with the accompanying drawings of which:

FIGS. 7A and 7B are diagrams showing a comparison of length of the air intake path provided in the throttle body of the present invention and the length of the air intake path of a conventional throttle device.

DETAILED DESCRIPTION OF THE PREFERRED EMBODIMENTS

Figure 1:
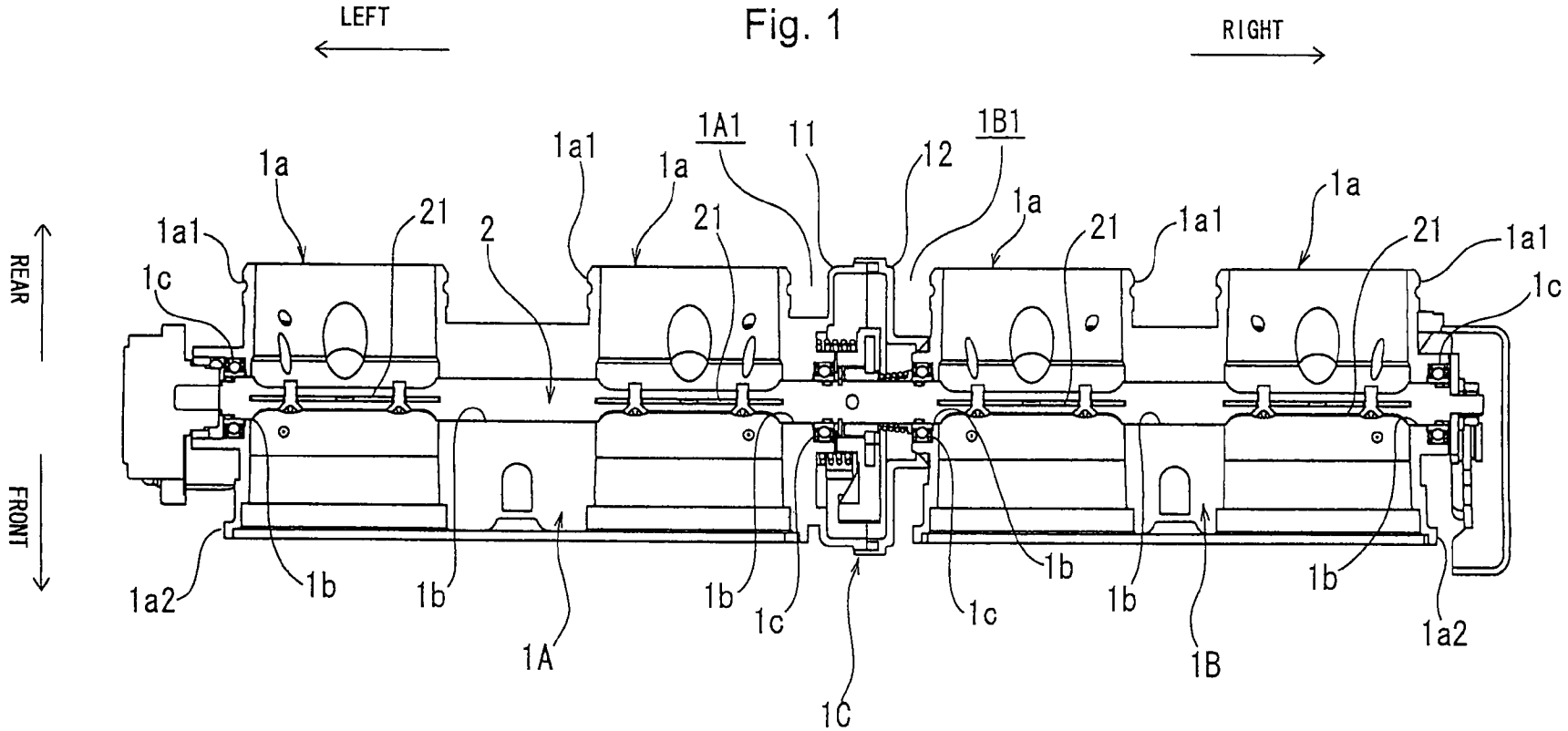
FIG. 1 is a cross-sectional diagram viewed from above schematically showing the constitution of a throttle device according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Figure 2:
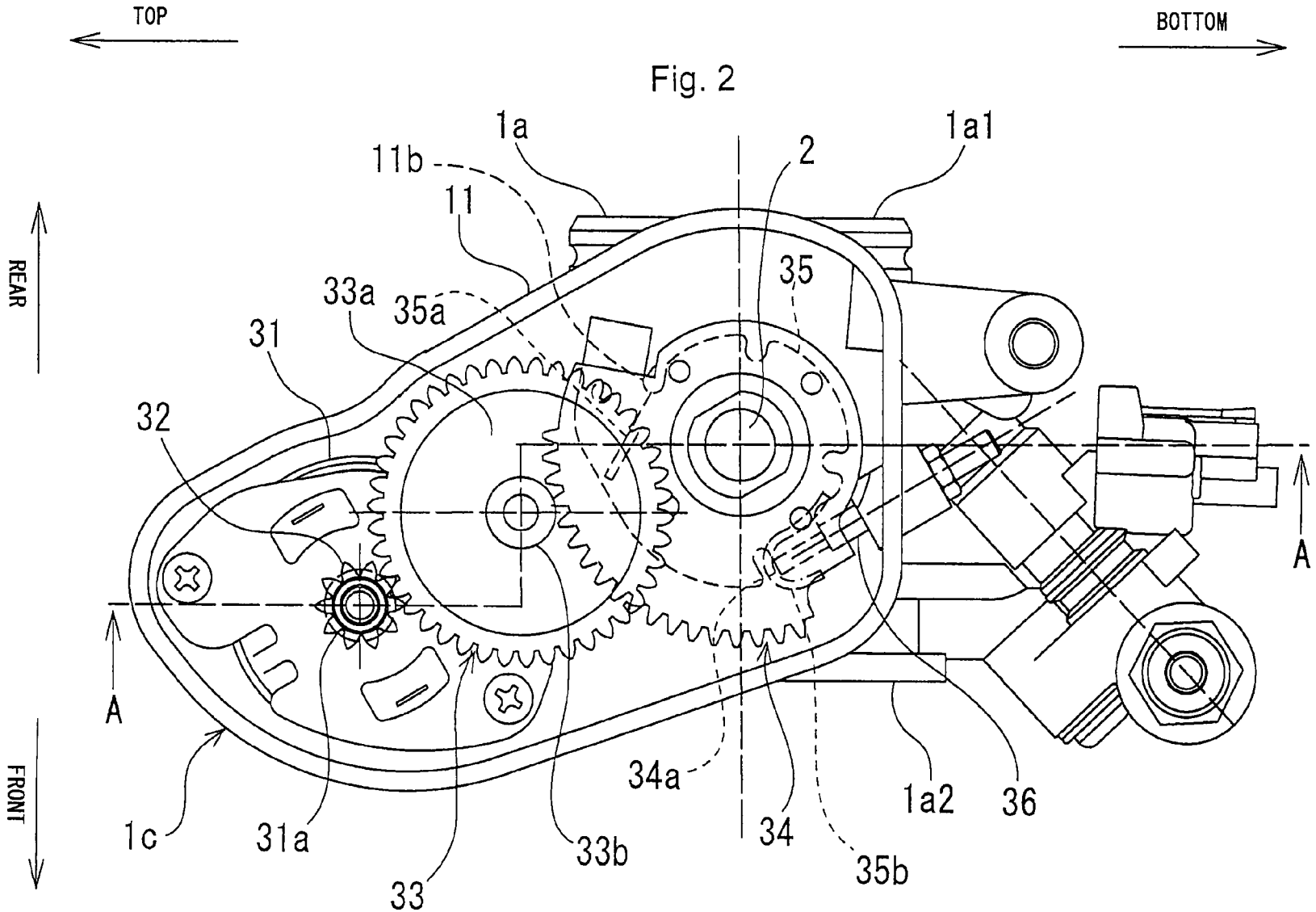
FIG. 2 is a cross-sectional diagram viewed from the left schematically showing the constitution of the gear case of the throttle device.
Figure 3:
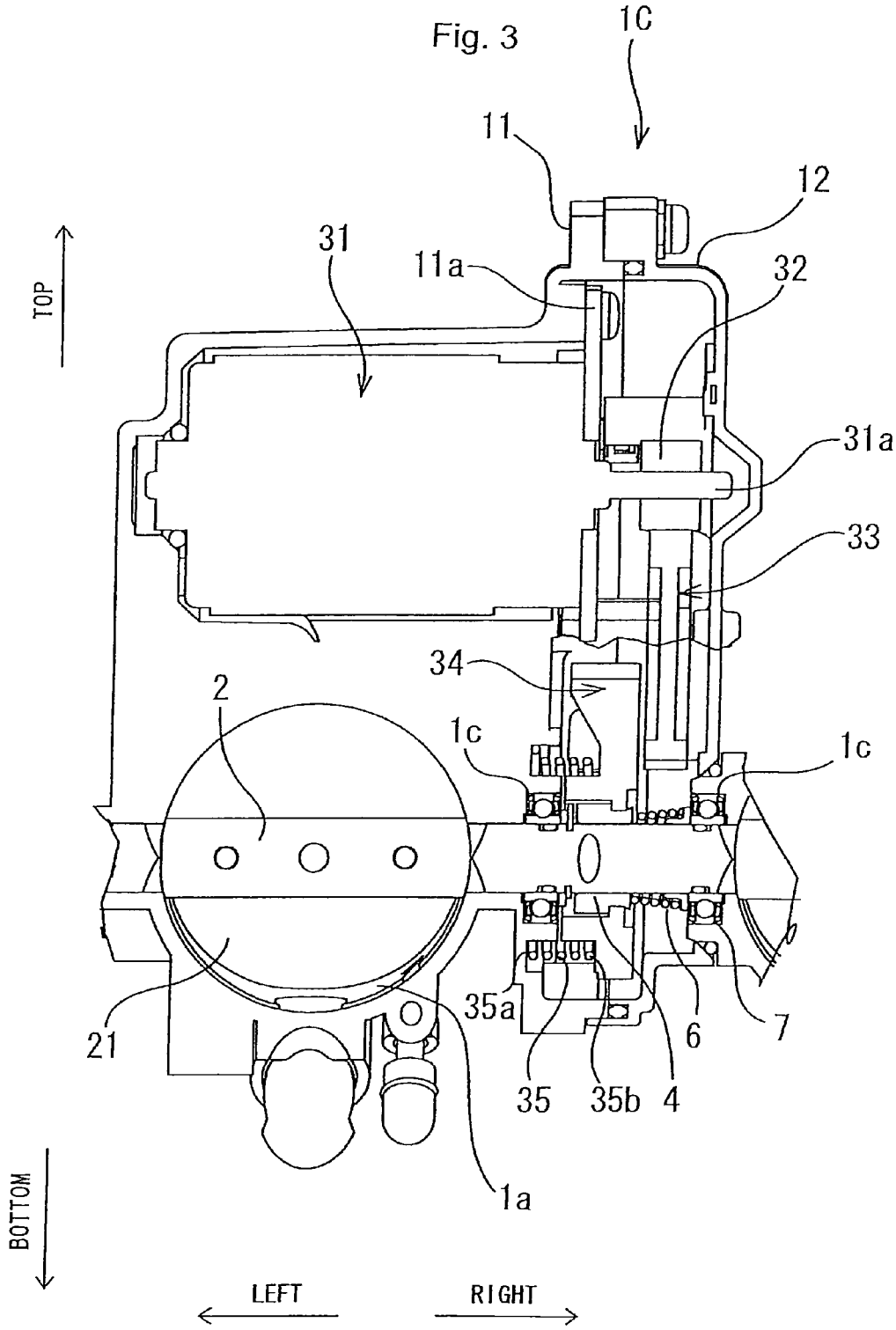
FIG. 3 is a cross-sectional diagram at the line A-A in FIG. 2, schematically showing the constitution of the gear case.

FIG. 1 is a cross-sectional diagram viewed from above schematically showing the constitution of a throttle device 1 according to the present embodiment. FIG. 2 is a cross-sectional diagram viewed from the left schematically showing the constitution of a gear case 1C of the throttle device 1. FIG. 3 is a cross-sectional diagram at the line A-A in FIG. 2, schematically showing the constitution of the gear case 1C. The directions top and bottom, front and rear, left and right used in the following explanation are shown on the drawings. The terms top and bottom, front and rear, left and right are used for explanation, and may differ from the actual orientation used.

As shown in FIG. 1, the throttle device 1 is constituted from a pair of throttle bodies 1A and 1B disposed to the left and right of the gear case 1C, each throttle body 1A, 1B is provided with an air intake path 1*a* on the left and right. The air intake path 1*a* includes a cylindrical shaped rear end aperture 1*a*1 that extends to the rear and that is fitted to the outside of a carburetor joint for installing the throttle device 1 on the engine, and a front end aperture 1*a*2 to which the connection portion of an air cleaner is screwed.

The throttle bodies 1A and 1B are provided with bearing holes 1*b* into which a throttle shaft 2 is inserted. The bearing holes 1*b* penetrate the throttle bodies 1A, 1B in the left-right direction, and intersect the axial center of the air intake paths 1*a*, and rotatably support the throttle shaft 2. The throttle shaft 2 that is inserted into the bearing holes 1*b* projects out from the left side of the left end of the throttle body 1A, and from the right side of the right end of the throttle body 1B. The throttle shaft 2 is rotatably supported by bearings 1*c* fitted to both the left and right sides of the throttle bodies 1A and 1B. Four throttle valves 21 for opening and closing the air intake paths 1*a* are fixed to the throttle shaft 2 that passes through the bearing holes 1*b* and is supported by the throttle bodies 1A and 1B.

The gear case 1C is constituted from a lid portion 11 that extends from the right side surface of the throttle body 1A and is integral with the throttle body 1A, and a resin lid member 12. The lid portion 11 is sectioned off from the throttle body 1A by a depression portion 1A1. The lid member 12 that is fitted to the lid portion 11 is assembled onto the left side of the throttle body 1B.

As shown in FIGS. 2 and 3, the gear case 1C includes a motor 31 fixed to the lid portion 11 by an installation plate 11*a*, a drive gear 32 for reducing the drive of the motor 31 and transmitting it to the throttle shaft 2, an intermediate gear 33, and a driven gear 34. The drive gear 32 is fixed to an output shaft 31*a* of the motor 31 and meshes with a large gear 33*a* of the intermediate gear 33. The intermediate gear 33 axially supported by the lid portion 11 meshes, at a small gear 33*b*, with a driven gear 34. The driven gear 34 is fixed to the throttle shaft 2, and meshes with a small gear 33*b*.

The driven gear 34 is impelled in one of the rotational directions (the open direction of the throttle valve or the closed direction of the throttle valve) by a rotational spring 35 placed between the lid portion 11 and the driven gear 34. The rotational spring 35 is fixed at one end 35*a* of the wound of this spring to the lid portion 11 at a fixing member 11*b*, and at the other end 35*b* to a retaining member 34*a* of the driven gear 34. The lid portion 11 is provided with a stopper 36 that contacts the retaining member 34*a* to regulate the rotation of the driven gear 34.

Figure 4:
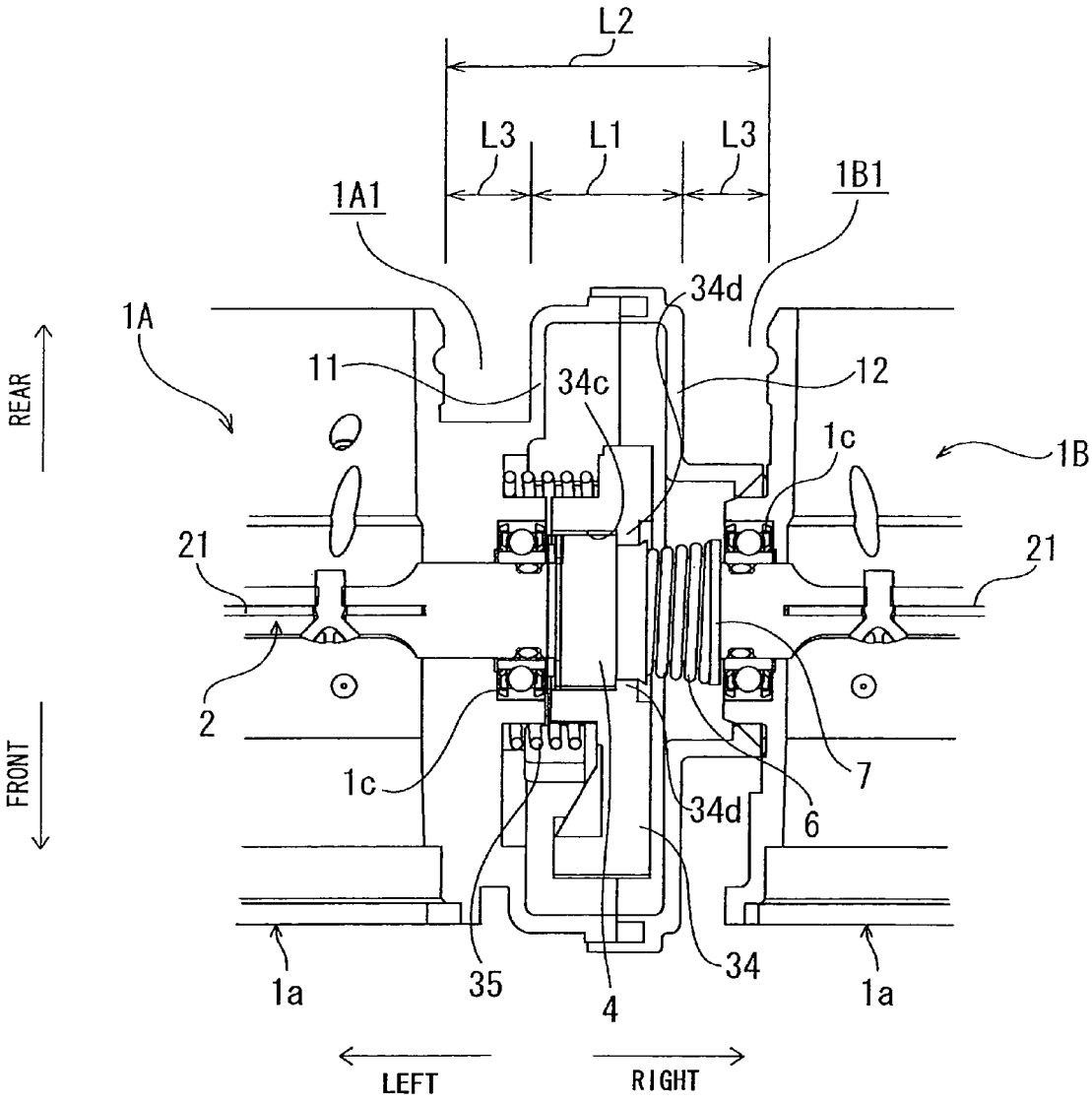
FIG. 4 is a diagram for explaining the installation structure of the driven gear on the throttle shaft, showing a cross-section of the gear case viewed from above.
Figure 5:
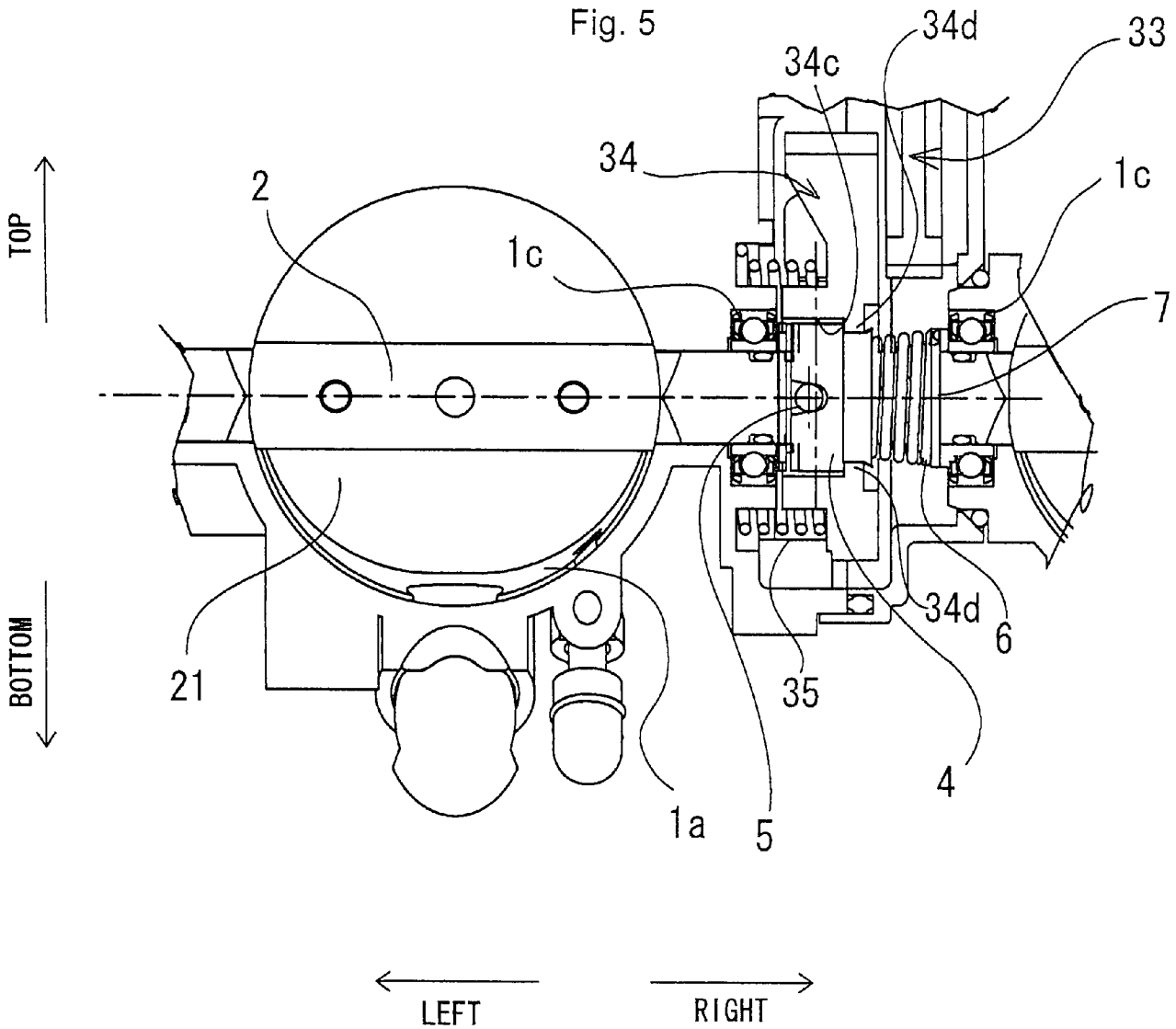
FIG. 5 is a diagram for explaining the installation structure of the driven gear on the throttle shaft, showing a cross-section of the gear case viewed from the front.
Figure 6:
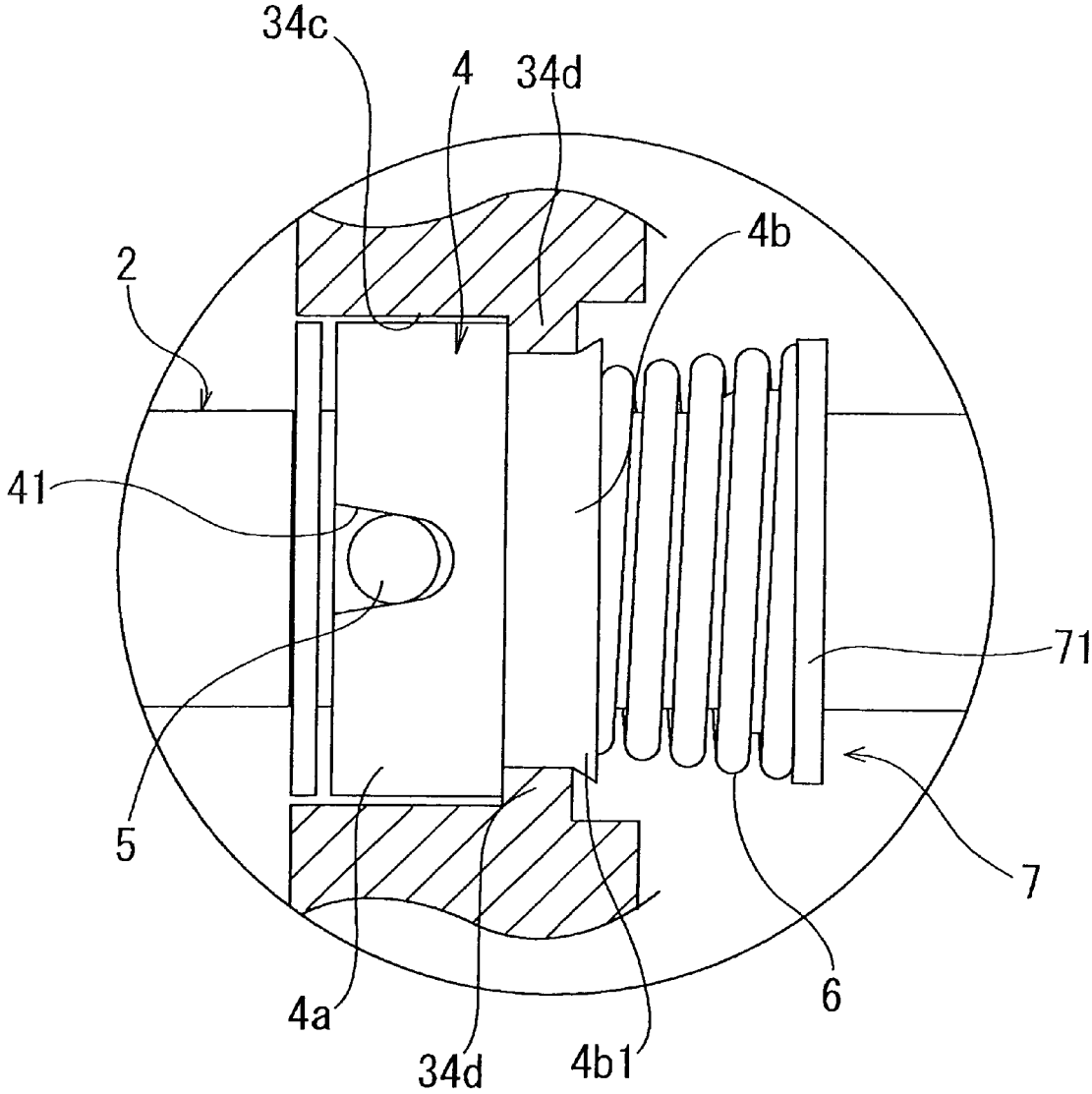
FIG. 6 is an enlarged diagram for explaining the installation structure of the fixing ring on the throttle shaft and the driven gear.

Next, the installation structure of the driven gear 34 on the throttle shaft 2 is explained. FIGS. 4 and 5 are diagrams for explaining the installation structure of the driven gear 34 on the throttle shaft 2. FIG. 4 is a cross-sectional diagram of the gear case 1C viewed from above, and FIG. 5 is a cross-sectional diagram of the gear case 1C viewed from the front. FIG. 6 is an enlarged diagram for explaining the installation structure of the driven gear 34 on the throttle shaft 2.

The driven gear 34 is fitted and fixed to the throttle shaft 2 with a fixing ring 4 that is constituted as a separate member. A fitting protrusion 34*d* on which the fixing ring 4 is fitted is provided on the inner peripheral surface of an insertion hole 34*c* formed in the driven gear 34. The fitting protrusion 34*d* is located at the right end of the insertion hole 34*c*, extending in a ring shape along the circumferential direction of the insertion hole 34*c*.

The fixing ring 4 has a substantially circular cylindrical shape, and includes an insertion portion 4*a* whose external diameter is virtually equal to the internal diameter of the insertion hole 34*c*, and a fitting portion 4*b* whose external diameter is reduced to slightly larger than that of the fitting protrusion 34*d*, and which extends to the right from the insertion portion 4*a*. A housing groove 41 is provided in the peripheral wall of the insertion portion 4*a* from the left end to the center in the left-right direction. The housing groove 41 has the shape of a notch, whose width reduces in a tapered shape from the entrance to the groove located at the left end of the insertion portion 4*a* towards the bottom of the groove. A press fit hole (not shown on the drawings) is formed on the outer peripheral surface of the throttle shaft 2, and a pin 5 is fitted into and fixed in the press fit hole. A thickened enlarged diameter portion 4*b*1 is provided on the right end of the fitting portion 4*b* at a distance from the left end of the fitting portion 4*b* that is virtually equal to the thickness of the fitting protrusion 34*d*, having a tapered shape in which the outer diameter increases towards the right end.

The fixing ring 4 is inserted into the left side of the insertion hole 34*c* from the fitting portion 4*b* side, the taper shaped enlarged diameter portion 4*b*1 of the fitting portion 4*b* is inserted into the fitting protrusion 34*d* from its right side, so that the fitting portion 4*b* is fitted inside the fitting protrusion 34*d*. The right end surface of the insertion portion 4*a* of the fixing ring 4 that has been fitted inside the fitting protrusion 34*d* contacts the left side surface of the fitting protrusion 34*d*, the fitting protrusion 34*d* is sandwiched between the right end surface of the insertion portion 4*a* and the enlarged diameter portion 4*b*1 of the fitting portion 4*b*, so the fixing ring 4 is fixed to the driven gear 34.

The driven gear 34 is fitted to the throttle shaft 2 so that the housing groove 41 provided on the fixing ring 4 engages with the pin 5 on the outer surface of the throttle shaft 2, the fitting portion 4*b* of the fixing ring 4 is pressed towards the pin 5 by the impelling force of a spring 6 that presses from the right side, so the position of the driven gear 34 is determined relative to the throttle shaft 2 in both the circumferential direction and the left to right direction.

The spring 6 is constituted with the internal diameter on the left end slightly larger than the external diameter of the throttle shaft 2, and with the internal diameter gradually increasing from the left end towards the right end. The spring is fitted around the throttle shaft 2 with the right end supported by a support ring 7. The support ring 7 has a thick cylindrical shape whose external diameter gradually increases from the left end to the right end, with a rim portion 71 projecting out at the right end. The support ring 7 supports the right end of the spring 6 from the inside on the outer peripheral surface of the support ring 7, and supports the right end of the spring 6 from the right side with the left end surface of the rim portion 71. The movement to the right of the support ring 7 is regulated by the bearing 1*c* supported on the throttle body 1B.

According to the present embodiment, the pin 5 provided on the peripheral surface of the throttle shaft 2 is housed in the housing groove 41 provided on the fixing ring 4 which forms the external fitting portion of the driven gear 34 onto the throttle shaft 2, and by pressing the pin 5 into the housing groove 41 with the impelling force of the spring 6, the driven gear 34 becomes fixed to the throttle shaft 2, and the two become integral. Therefore it is not necessary to provide space to contain the external fitting portion of the driven gear 34 onto the throttle shaft 2 within the gear case 1C. As a result, it is possible to make the gear case 1C smaller and simplify its shape. Also, the freedom of layout of the motor 31 and the gears 32 through 34 within the gear case 1C is increased, and the freedom of setting the gear ratio is also increased.

Also, according to the present embodiment, it is possible to make the width of the gear case 1C between the throttle bodies 1A, 1B narrower in the left to right direction. Therefore, it is possible to provide the depression portions 1A1, 1B1 for fitting the connection portions of the carburetor joint and the air cleaner to the air intake path 1*a* between the throttle bodies 1A, 1B and the gear case 1C, so the overall length of the air intake path 1*a* can be made shorter. In other words, by making the gear case 1C smaller by eliminating the space to contain the external fitting portion for the driven gear 34, it is possible to provide the space to form the depression portions 1A1, 1B1 for housing the carburetor joint and air cleaner connections between the throttle bodies 1A, 1B.

In other words, as shown in FIG. 4, by making the width L1 of the gear case 1C narrower, and keeping the distance L2 between the two throttle bodies 1A, 1B the same, it is possible to increase the gap L3 between the throttle bodies 1A, 1B and the gear case 1C. Therefore, it is possible to house a part of the carburetor joint and air cleaner connections for fitting to the air intake path 1*a* in the depression portions 1A1, 1B1 between the throttle bodies 1A, 1B and the gear case 1C.

In the conventional throttle device 10 shown in FIG. 7A, in order to avoid interference between the gear case 1C and the carburetor joint and air cleaner connectors, the front end aperture 1*a*1 and the rear end aperture 1*a*2 of the air intake path 1*a* are disposed to the outside (in the front direction and the rear direction) of the gear case 1C. However, in the throttle device 1 shown in FIG. 7B, it is possible to dispose the front end aperture 1*a*1 and the rear end aperture 1*a*2 of the air intake path 1*a* within the gear case 1C. Therefore it is possible to reduce the total length H1 of the air intake path 1*a* in the throttle device 10 to the length H2 in the throttle device 1. Therefore, the capacity of the air intake path 1*a* on the downstream side of the throttle valve 21 is reduced, so it is possible to improve the responsiveness of the engine. In a multiple throttle device having a plurality of throttle bodies also it is possible to improve the engine responsiveness by providing the throttle device 1 with short air intake pipes, as described above.

Also, by reducing the gap between the throttle bodies 1A, 1B it is possible to reduce the size of the throttle device 1. Also, the shape of the gear case 1C can be freely selected, so it is possible to add another function to the gear case 1C. For example, it is possible to add a holder function for a peripheral component to the resin lid member 12.

Also, according to the present embodiment, the pin 5 is always pressed into the housing groove 41 which is formed with a taper from the entrance to the bottom of the groove. Therefore, even if wear occurs between the housing groove 41 and the pin 5, the connection between the housing groove 41 and the pin 5 is maintained, and it is possible to prevent rattling from occurring between the two.

Also, the throttle valves 21 provided in the throttle bodies 1A, 1B are opened and closed using a single throttle shaft 2. Therefore, it is possible to accurately coordinate the opening and closing of each of the throttle valves 21 without providing a mechanism for coordinating a plurality of throttle shafts. As a result, it is possible to provide a compact throttle device 1 with throttle valves having good rotational responsiveness in a multiple throttle device having a plurality of throttle bodies.

In the embodiment as described above, the case in which the pin 5 was fitted into the fitting hole formed in the outer peripheral surface of the throttle shaft 2 to constitute a protrusion was explained. However, the constitution of the protrusion is arbitrary, and for example the protrusion may be formed integrally with the throttle shaft 2. Also, the shape of the pin 5 that protrudes from the outer peripheral surface of the throttle shaft 2 is arbitrary, provided that it is possible to determine the position with the housing groove 41 of the fixing ring 4 that presses against it.

Also, in the embodiment as described above, the case in which the fixing ring 4 which is constituted as a separate member from the driven gear 34 is the external fitting portion of the driven gear 34 on the throttle shaft 2 was explained. However, the driven gear 34 and the fixing ring 4 may be formed integrally. In other words, the housing groove 41 may be provided in the peripheral wall of the fitting hole 34*c*, without providing a separate member for fixing the driven gear 34 onto the throttle shaft 2. Also, the method of fixing the fixing ring 4 to the driven gear 34 is arbitrary, and the fixing ring 4 may be fitted as it is to the fitting hole 34*c*, without providing the fitting protrusion 34*d* in the fitting hole 34*c*.

Also, the shape of the housing groove 41 is arbitrary, provided it is possible to engage with the pin 5 and determine the position of the fixing ring 4 relative to the throttle shaft 2. The shape of the housing groove 41 does not necessarily have to be tapered from the entrance of the groove to the bottom. The housing groove 41 does not have to penetrate from the inside to the outside of the insertion portion 4*a*, but for example may be constituted by providing a depression on the inside of the insertion portion 4*a*. Also, the constitution of the impelling means is arbitrary provided it is possible to press the pin 5 against the housing groove 41 of the fixing ring 4 so that their positions are determined.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A throttle device, comprising:

a throttle body that defines an air intake path;

a throttle valve that is disposed in the air intake path and adjusts an air flow rate in the air intake path;

a throttle shaft that rotatably supports the throttle valve;

a protrusion provided on a peripheral surface of the throttle shaft;

a motor that rotates the throttle shaft; and a gear that connects the throttle shaft to the motor, the gear including an external fitting portion that is externally fitted to the throttle shaft and a housing groove formed in the external fitting portion to house the protrusion, the housing groove being impelled against the protrusion by impelling means.

2. The throttle device according to claim 1, further comprising a gear case enclosing the gear, the gear case including an assembly of a pair of lid members, at least one of the lid members being formed integrally with the throttle body, and the throttle body and the lid member being partitioned by a depression portion.

3. The throttle device according to claim 1, wherein the housing groove is formed in a shape tapering from an entrance to the groove to a bottom thereof.

4. The throttle device according to claim 2, wherein the housing groove is formed in a shape tapering from an entrance to the groove to a bottom thereof.

* * * * *